US009400466B2

(12) United States Patent
Tani et al.

(10) Patent No.: US 9,400,466 B2
(45) Date of Patent: Jul. 26, 2016

(54) IMAGE FORMING APPARATUS INCLUDING A ROTATABLE CAM CONFIGURED TO MOVE A SHUTTER MEMBER

(71) Applicant: CANON KABUSHIKI KAISHA, Tokyo (JP)

(72) Inventors: Nobuhiro Tani, Matsudo (JP); Tomoharu Kitajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/667,084

(22) Filed: Mar. 24, 2015

(65) Prior Publication Data

US 2015/0277319 A1 Oct. 1, 2015

(30) Foreign Application Priority Data

Mar. 31, 2014 (JP) ..... 2014-074927

(51) Int. Cl.
*G03G 15/00* (2006.01)

(52) U.S. Cl.
CPC ..... *G03G 15/50* (2013.01)

(58) Field of Classification Search
CPC ..... G03G 15/05
USPC ..... 399/74
See application file for complete search history.

(56) References Cited

U.S. PATENT DOCUMENTS

| | | | | |
|---|---|---|---|---|
| 6,321,044 | B1 | 11/2001 | Tanaka | |
| 2011/0026953 | A1* | 2/2011 | Tomita | G03G 15/161 399/44 |
| 2013/0004189 | A1 | 1/2013 | Hashiguchi et al. | |
| 2014/0064770 | A1 | 3/2014 | Yanata | |
| 2014/0147153 | A1 | 5/2014 | Murayama | |
| 2014/0294420 | A1 | 10/2014 | Lee | |

FOREIGN PATENT DOCUMENTS

| | | | |
|---|---|---|---|
| JP | H05-181363 | A | 7/1993 |
| JP | 2002-131997 | A | 5/2002 |
| JP | 2007-298782 | A | 11/2007 |
| JP | 4724288 | B2 | 7/2011 |

OTHER PUBLICATIONS

U.S. Appl. No. 14/672,051, filed Mar. 27, 2015.

* cited by examiner

*Primary Examiner* — Quana M Grainger
(74) *Attorney, Agent, or Firm* — Canon USA, Inc. I.P. Division

(57) ABSTRACT

An image forming apparatus includes a movable image-bearing member, a sensor opposed to the image-bearing member, a shutter member arranged between the image-bearing member and the sensor and capable of moving between an open position and a closed position, a rotatable cam configured to move the shutter member, and an execution portion configured to selectively execute a first mode in which the shutter member is opened or closed by rotating the cam within a first phase range and a second mode in which the shutter member is vibrated by rotating the cam at least through a second phase range different from the first phase range.

9 Claims, 10 Drawing Sheets

IMAGE FORMING APPARATUS INCLUDING A ROTATABLE CAM CONFIGURED TO MOVE A SHUTTER MEMBER

BACKGROUND OF THE INVENTION

1. Field of the Invention

The present invention relates to an image forming apparatus including a sensor that detects an object to be detected.

2. Description of the Related Art

A known image forming apparatus using an electrographic process or the like reads a reference image on an image conveyance member using a sensor as a detecting unit, calculates the amount of misalignment from the reference in the result of the reading, corrects the amount of color misalignment and the density of the image, and maintains its proper setting. In this case, the sensor is an optical sensor. Examples of the image conveyance member may include a photosensitive member, an intermediate transfer member, and a transfer material carrier.

For example, in a tandem image forming apparatus employing an intermediate transfer method, a reference image for color misalignment correction for each color is formed on an intermediate transfer member by an image forming portion for each color, the position of the reference image for each color is detected by a sensor, and color misalignment is corrected. In this image forming apparatus, a reference image for density correction for each color is formed on the intermediate transfer member by the image forming portion for each color, the density of the reference image for each color is detected by the sensor, and the density for each color is corrected.

One factor in decreasing the accuracy of detection of the above-described sensor may be a flutter of the reference image, which is an object to be detected. For example, when the intermediate transfer member having an endless belt shape flutters in the direction of the depth of the sensor, there are variations in results of detection of reference images. To avoid such variations, fluttering of the intermediate transfer member may be reduced by arrangement of a roller in a location opposed to the sensor on the inner circumferential surface side of the intermediate transfer member. However, while an image transferred to the surface of the intermediate transfer member (output image or reference image) is passing through a location above the roller having a potential difference therefrom, toner may scatter from the surface of the intermediate transfer member. The scattered toner may be directed toward the detecting surface of the sensor arranged in the vicinity of the intermediate transfer member and may adhere to the detecting surface of the sensor.

An openable and closable shutter member (protective member) for protecting the sensor may be disposed between the sensor and the intermediate transfer member, as described in Japanese Patent No. 4724288.

SUMMARY OF THE INVENTION

An image forming apparatus according to the present invention includes a movable image-bearing member configured to bear a toner image, a sensor opposed to the image-bearing member, a shutter member arranged between the sensor and the image-bearing member and movable between an open position at which the sensor is exposed to the image-bearing member and a closed position at which the sensor is shielded from the image-bearing member, a rotatable cam configured to move the shutter member, and an execution portion capable of selectively executing a first mode in which the cam is rotated within a first phase range and the shutter member is opened or closed and a second mode in which the cam is rotated at least through a second phase range different from the first phase range and the shutter member is vibrated.

Further features of the present invention will become apparent from the following description of exemplary embodiments with reference to the attached drawings.

DESCRIPTION OF THE EMBODIMENTS

An image forming apparatus according to the present invention will be described in detail below with reference to the drawings.

First Embodiment

1. General Configuration and Operation of Image Forming Apparatus

Figure 1:
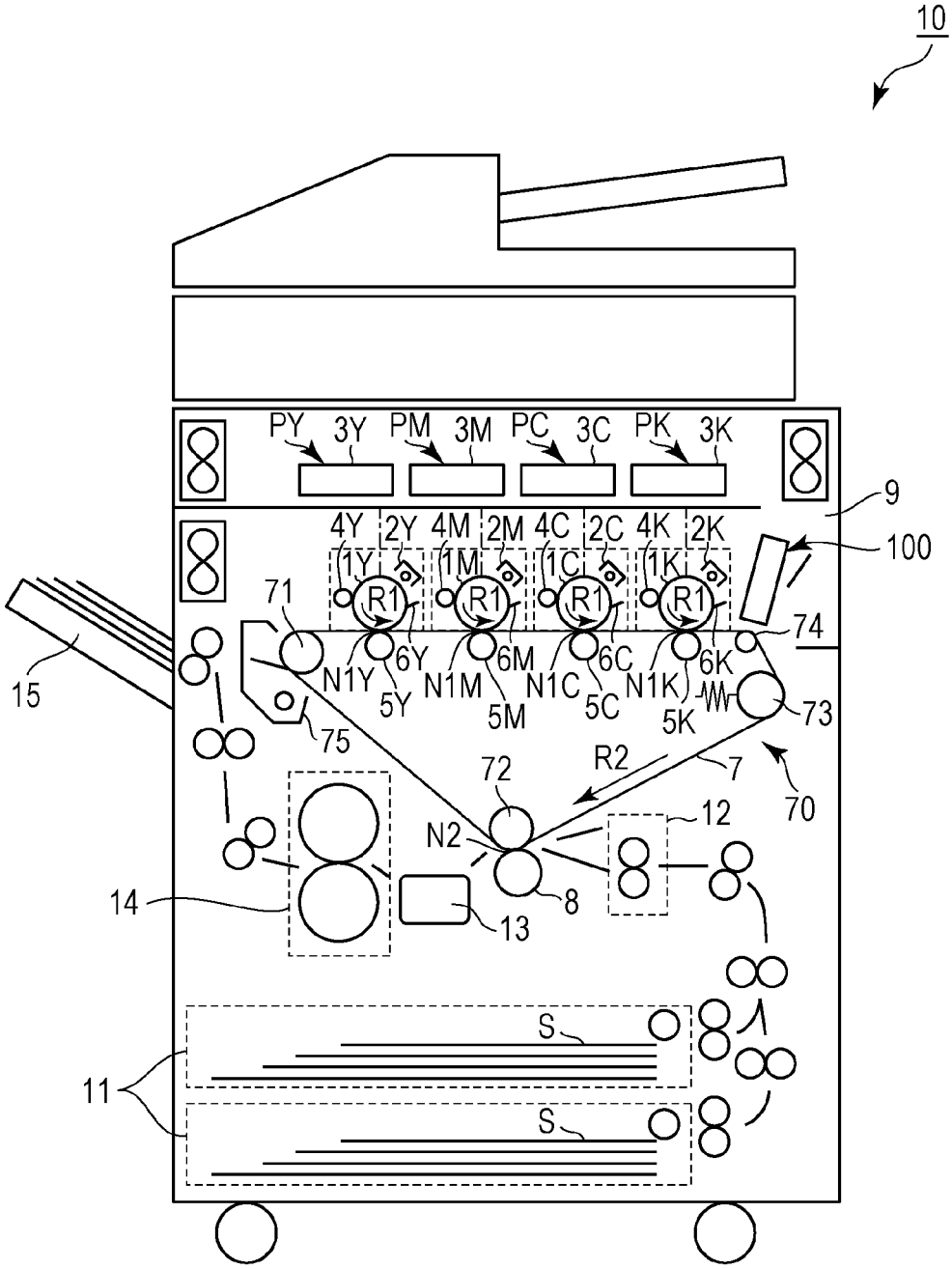
FIG. 1 is a schematic cross-sectional view of an image forming apparatus.

FIG. 1 is a schematic cross-sectional view of an image forming apparatus according to an embodiment of the present invention. An image forming apparatus 10 in the present embodiment is a tandem color copier that can create a full-color image using an electrophotographic method and that employs an intermediate transfer system.

The image forming apparatus 10 includes first, second, third, and fourth image forming portions (stations) PY, PM, PC, and PK configured to form yellow (Y), magenta (M), cyan (C), and black (B) images, respectively, as a plurality of image forming portions. In the present embodiment, the configurations and operations of the image forming portions PY, PM, PC, and PK are substantially the same, except for used toner colors. Accordingly, when it is not necessary to distinguish among them, the suffixes Y, M, C, and K indicating the elements for individual colors are omitted and the elements are collectively described. In the description below, the front side of the sheet surface in FIG. 1 is the front (front face) side of the image forming apparatus 10, and the back side of the sheet surface in FIG. 1 is the back (rear face) side of the image forming apparatus 10. The left side and right side of the image forming apparatus 10 as seen from the front side of the image forming apparatus 10 are the left side and right side of the image forming apparatus 10. The depth direction connecting the front side and the back side of the image forming apparatus 10 is substantially parallel to the rotational axis direction of a photosensitive drum 1 described below.

The photosensitive drum 1 is disposed in the image forming portion P. The photosensitive drum 1 is an electrophotographic photosensitive member (photosensitive member) having a drum shape (cylindrical shape) as an image-bearing member. The photosensitive drum 1 is rotationally driven by a drive motor (not illustrated) as a driving unit in the direction of an arrow R1 in FIG. 1. Units described below are arranged around the photosensitive drum 1 along its rotational direction. First, a charger 2 as a charging unit is arranged. Next, an exposing device (laser scanner device) 3 as an exposure unit is arranged. Next, a developing device 4 as a developing unit is arranged. Next, a primary transfer roller 5 being a primary transfer member having a roller shape as a primary transfer unit is arranged. Next, a drum cleaner 6 as a photosensitive-member cleaning unit is arranged.

The rotating photosensitive drum 1 is uniformly charged by the charger 2. An electrostatic latent image (electrostatic image) is formed on the photosensitive drum 1 by scanning exposure performed on the charged surface of the photosensitive drum 1 by the exposing device 3. The electrostatic latent image formed on the photosensitive drum 1 is developed by the developing device 4 using toner as a developing material.

The exposing device 3 includes a laser whose light emission is controlled in accordance with an image signal and a plurality of mirror portions configured to guide laser beams onto the photosensitive drum 1. Adjustment of the light emission timing in the laser and the mirrors enables timing of writing an image to be adjusted and the position of the beginning of writing for each color to be adjusted. Adjustment of a potential of the photosensitive drum 1 and the amount of light of the laser enables the density of the image to be adjusted.

An intermediate transfer belt 7 being an intermediate transfer member having an endless belt shape is arranged below the photosensitive drums 1Y, 1M, 1C, and 1K such that the intermediate transfer belt 7 horizontally passes through the image forming portions PY, PM, PC, and PK. The intermediate transfer belt 7 is one example of a movable image conveyance member. The intermediate transfer belt 7 is wound around a drive roller 71, a secondary-transfer counter roller 72, a tension roller 73, and a backup roller 74 as a plurality of supporting rollers. The intermediate transfer belt 7 is rotated (cyclically moved) along the direction of an arrow R2 in FIG. 1 by application of a driving force from a drive motor (not illustrated) as a driving unit to the drive roller 71. The intermediate transfer belt 7 is stretched around the plurality of supporting rollers in a state where a predetermined tension is provided thereto by the tension roller 73 urged from the inner circumferential surface side toward the outer circumferential surface side. The above-mentioned primary transfer rollers 5 are arranged in locations opposed to the photosensitive drums 1 on the inner circumferential surface side of the intermediate transfer belt 7. Each of the primary transfer rollers 5 is urged (pressed) toward the photosensitive drum 1 through the intermediate transfer belt 7. A primary transfer portion (primary transfer nip portion) N1 where the intermediate transfer belt 7 and the photosensitive drum 1 are in contact with each other is defined. A secondary transfer roller 8 being a secondary transfer member having a roller shape as a secondary transfer unit is arranged in a location opposed to the secondary-transfer counter roller 72 on the outer circumferential surface side of the intermediate transfer belt 7. The secondary transfer roller 8 is urged (pressed) toward the secondary-transfer counter roller 72 through the intermediate transfer belt 7. A secondary transfer portion (secondary transfer nip portion) N2 where the intermediate transfer belt 7 and the secondary transfer roller 8 are in contact with each other is defined. A belt cleaner 75 as an intermediate transfer member cleaning unit is arranged in a location opposed to the drive roller 71 on the outer circumferential surface side of the intermediate transfer belt 7. The intermediate transfer belt 7, the supporting rollers 71, 72, 73, and 74 for the intermediate transfer belt 7, the belt cleaner 75, and the like constitute an intermediate transfer belt unit 70.

A toner image formed on the photosensitive drum 1 is (primarily) transferred to the intermediate transfer belt 7 at the primary transfer portion N1 by the action of the primary transfer roller 5 to which a primary transfer voltage (primary transfer bias) is applied. For example, in the case of forming a full-color image, toner images for individual colors are sequentially transferred onto the intermediate transfer belt 7 in the first, second, third, and fourth image forming portions PY, PM, PC, and PK such that the toner images overlap one another. The toner images transferred to the intermediate transfer belt 7 are (secondarily) transferred to a transfer material (sheet material) S, such as a recording sheet, at the secondary transfer portion N2 by the action of the secondary transfer roller 8 to which a secondary transfer voltage (secondary transfer bias) is applied. For example, in the case of forming a full-color image, the overlapping four-color toner images on the intermediate transfer belt 7 are collectively transferred to the transfer material S. The transfer material S is fed from a container 11 in a transfer material supply portion, the attitude of the transfer material S is aligned by a registration adjuster 12, and then it is conveyed to the secondary transfer portion N2.

The transfer material S with the toner image transferred thereto is borne on a conveyance belt 13 being a conveyance member having an endless belt shape. The conveyance belt 13 is driven by a drive motor (not illustrated) as a driving unit. A suction fan (not illustrated) for sucking the transfer material S is arranged on the inner circumferential surface side of the conveyance belt 13. The suction fan sucks the transfer material S onto the conveyance belt 13. After that, the transfer material S is conveyed to a fixing device 14 as a fixing unit arranged downstream of the conveyance belt 13 in its conveyance direction. The transfer material S is heated and pressed by the fixing device 14, and the toner image is fixed thereon. In this manner, the image is obtained on the transfer material S. Then, the transfer material S is conveyed to a transfer-material discharging portion and is discharged onto a transfer-material discharging tray 15 outside a main body 9 of the apparatus in the image forming apparatus 10 (outside the apparatus).

An adhering substance such as residual toner on the photosensitive drum 1 after primary transfer (primary transfer residual toner) is removed and collected from the photosensitive drum 1 by the drum cleaner 6. An adhering substance such as residual toner on the intermediate transfer belt 7 after secondary transfer (secondary transfer residual toner) is removed and collected from the intermediate transfer belt 7 by the belt cleaner 75.

Figure 5:
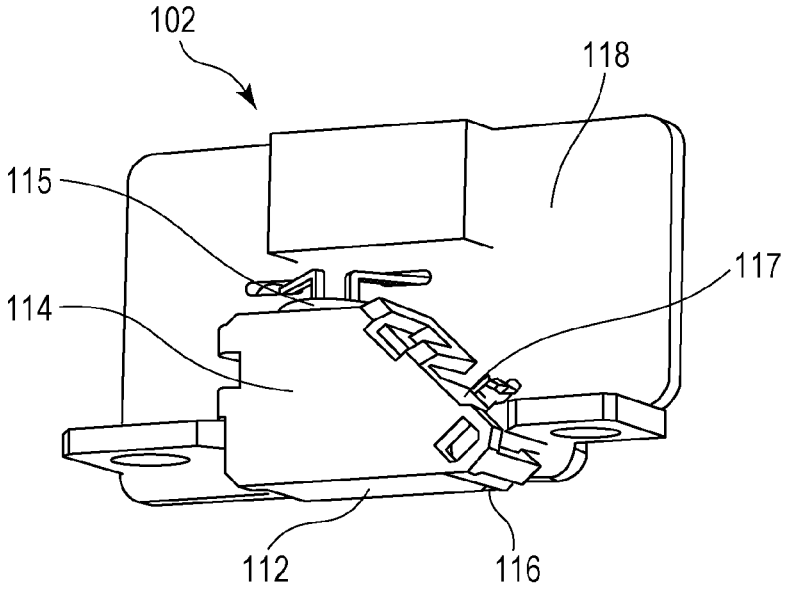
FIG. 5 is a perspective view of a registration sensor.
Figure 6:
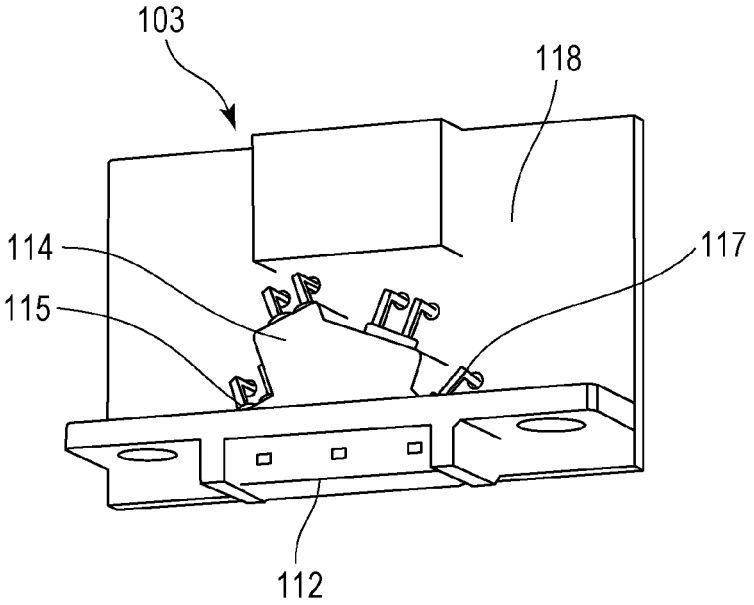
FIG. 6 is a perspective view of a density sensor.

The image forming apparatus 10 includes a sensor unit 100. The sensor unit 100 is arranged downstream of the primary transfer portion N1K, which is the most downstream in the conveyance direction of the transfer material S, and upstream of the secondary transfer portion N2 and is opposed to the outer circumferential surface of the intermediate transfer belt 7. The sensor unit 100 includes registration sensors 102 (FIG. 5) and density sensors 103 (FIG. 6). Each of the registration sensors 102 and the density sensors 103 is an optical sensor, is opposed to the image conveyance member, which is the intermediate transfer belt 7, and is configured to detect a state of an object to be detected on the image conveyance member. The sensor unit 100 is opposed to the backup roller 74 arranged on the inner circumferential surface side of the intermediate transfer belt 7. The sensor unit 100 will be described in further detail below.

Figure 2:
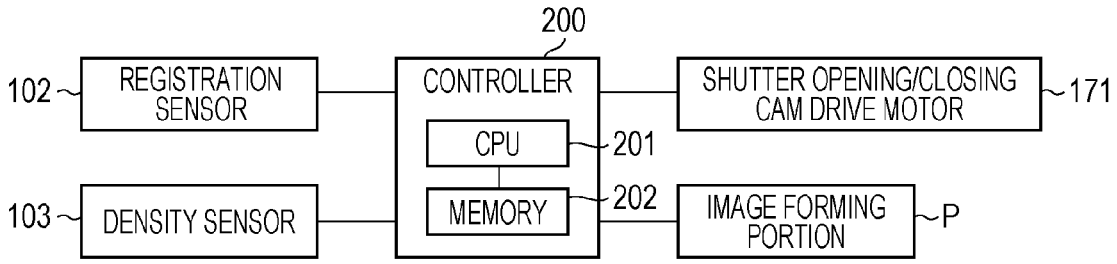
FIG. 2 is a schematic control block diagram of a main part in the image forming apparatus.

FIG. 2 illustrates a schematic control form of a main part in the image forming apparatus 10 in the present embodiment. The image forming apparatus 10 includes a controller 200 as a control unit. The controller 200 includes a central processing unit (CPU) 201 being a central element configured to perform computations and a memory 202 being a memory cell, such as read-only memory (ROM) and random-access memory (RAM). The RAM stores results of detection by the sensors, results of computations, and the like. The ROM stores a control program, a data table previously determined, and the like. In the present embodiment, the controller 200 provides overall control of the elements in the image forming apparatus 10. In a relationship with the present embodiment, the controller 200 performs controlling for correcting operations of the image forming portion P on the basis of results of detection by the registration sensors 102 and the density sensors 103, adjusting the position of the beginning of writing for each color, and adjusting the density of the image. The controller 200 performs controlling for driving a shutter opening/closing cam drive motor 171 in the sensor unit 100 in a way described below.

2. Sensor Unit

Figure 3:
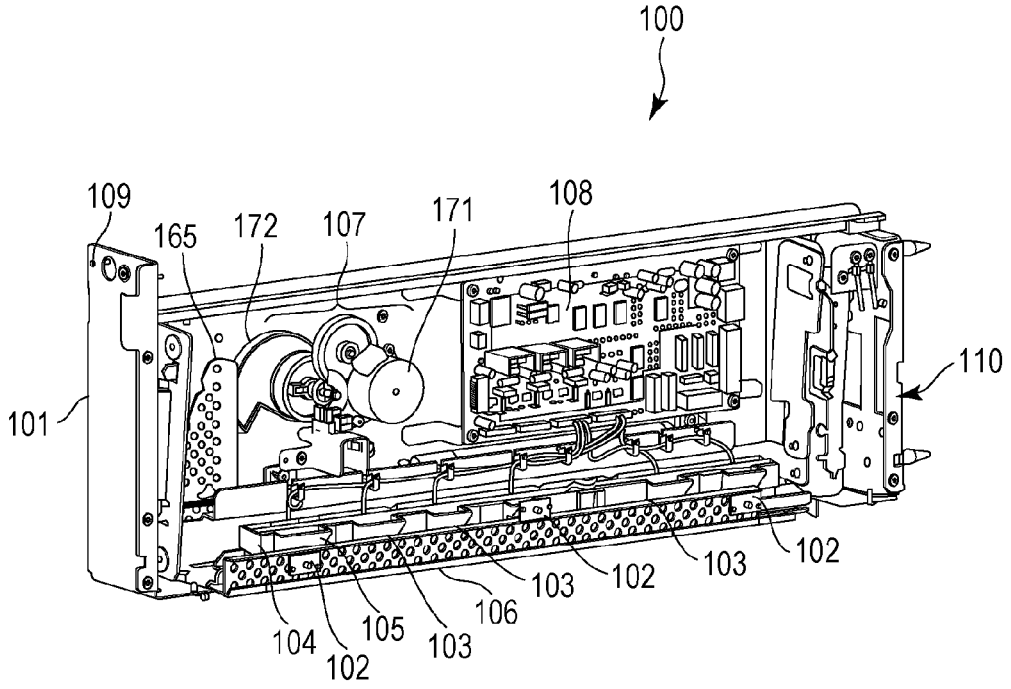
FIG. 3 is a perspective view that illustrates an inside of a sensor unit.
Figure 4:
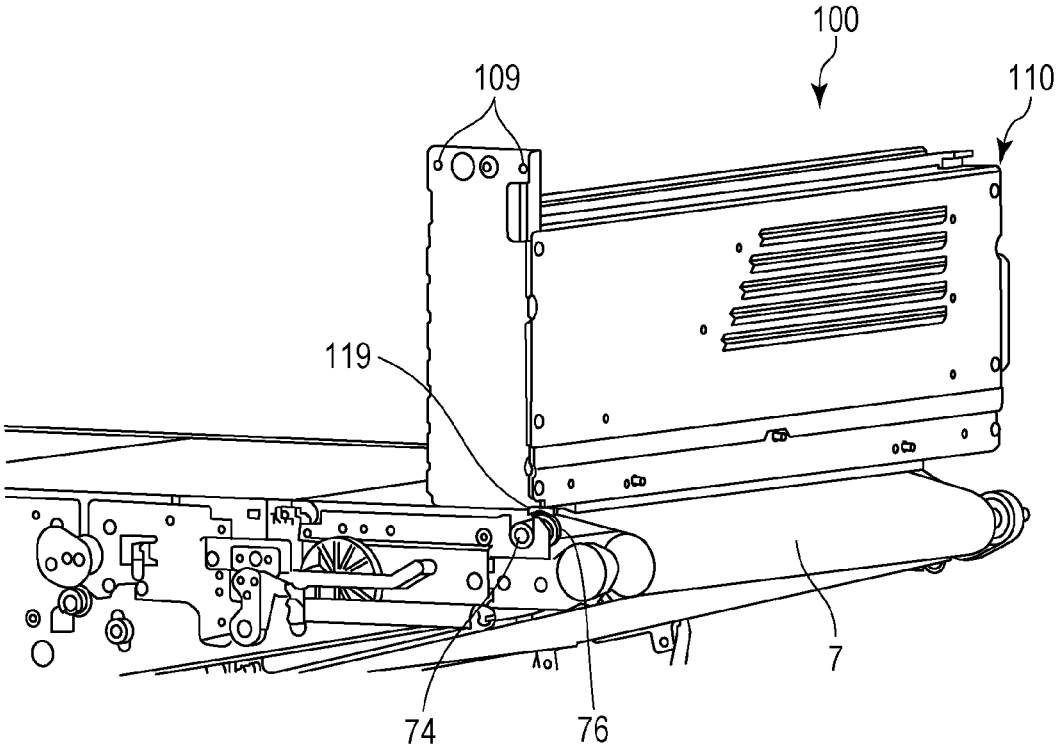
FIG. 4 is a perspective view of a portion where the sensor unit is mounted and its surroundings.
Figure 7:
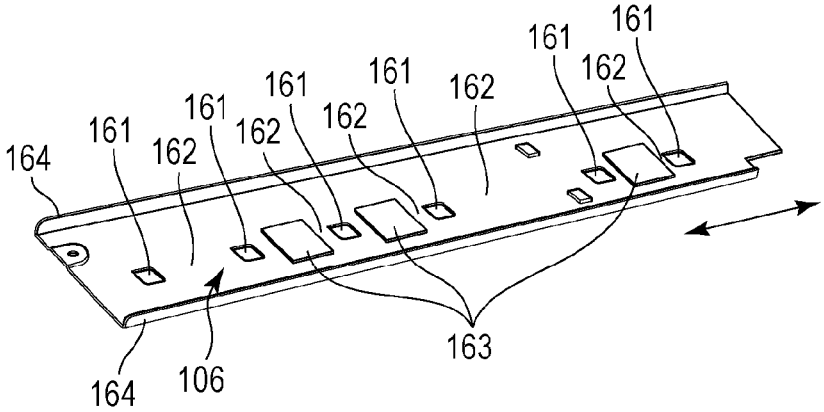
FIG. 7 is a perspective view of a shutter member in the sensor unit.
Figure 8:
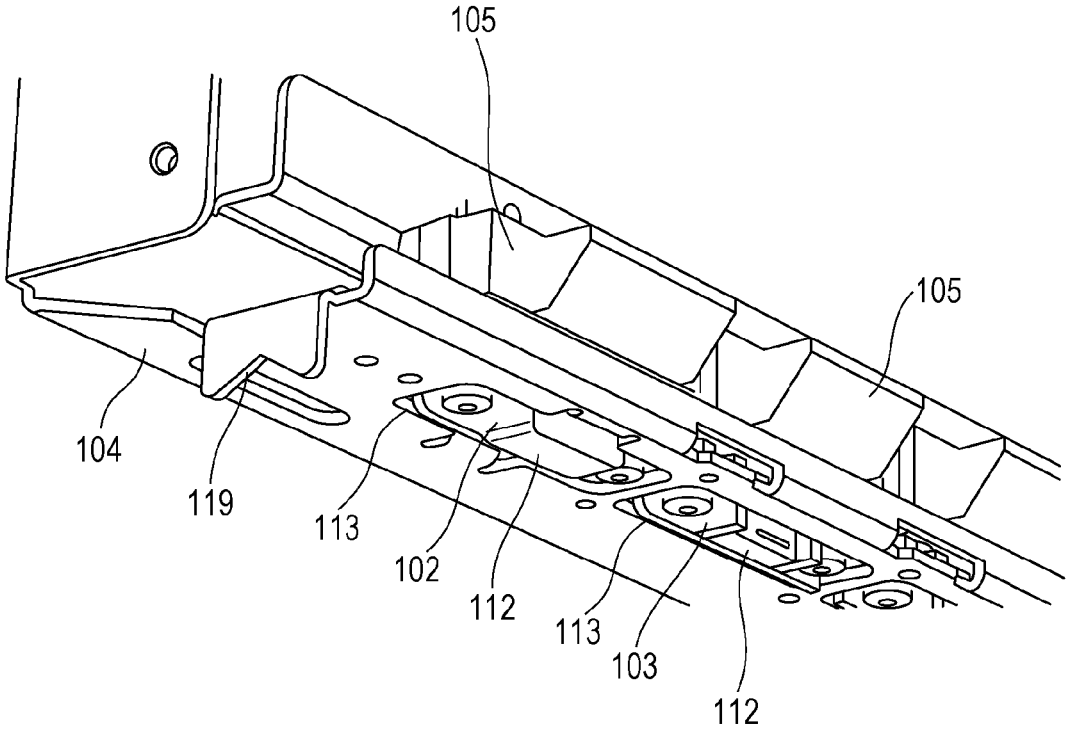
FIG. 8 is a perspective view of the sensor unit as seen from a detecting surface of a sensor.

Next, a general configuration and operation of the sensor unit 100 in the present embodiment is described. FIG. 3 is a perspective view that illustrates an inside of the sensor unit 100 as seen from the right side of the image forming apparatus 10. FIG. 4 is a perspective view of a portion where the sensor unit 100 is mounted and its surroundings. FIG. 5 is a perspective view of the registration sensor 102. FIG. 6 is a perspective view of the density sensor 103. FIG. 7 is a perspective view of a shutter member 106 in the sensor unit 100. FIG. 8 is a perspective view of the registration sensor 102 and the density sensor 103 mounted in the sensor unit 100 as seen from detection surfaces 112.

As illustrated in FIG. 3, the sensor unit 100 in the present embodiment includes elements described below as main components. First, the sensor unit 100 includes a frame 101 being a base of the sensor unit 100. The sensor unit 100 includes the registration sensors 102. Each of the registration sensors 102 is an optical sensor and configured to read a reference image for correcting color misalignment (color misalignment correction patch). The reference image is a toner image formed on the intermediate transfer belt 7. The sensor unit 100 includes the density sensors 103. Each of the density sensors 103 is an optical sensor and configured to read a reference image for correcting the density (density correction patch). The reference image is a toner image formed on the intermediate transfer belt 7. The sensor unit 100 includes a sensor supporting plate 104 on which the registration sensors 102 and the density sensors 103 are mounted. The frame 101 and the sensor supporting plate 104 constitute a housing 110 accommodating the registration sensors 102 and the density sensors 103. The sensor supporting plate 104 has detection openings 113 (FIG. 8) through which the detection surfaces 112 (FIGS. 5 and 6) of the registration sensors 102 and the density sensors 103 are exposed to the intermediate transfer belt 7. The sensor unit 100 includes ducts (sensor ducts) 105 sealing the registration sensors 102 and the density sensors 103 inside the housing 110 and introducing air to the detection openings 113. The sensor unit 100 includes the openable/closable shutter member (protective member, opening and closing member) 106 protecting the detection surfaces 112 of the registration sensors 102 and the density sensors 103 when they are inactive. The sensor unit 100 includes a shutter driving portion 107 configured to open or close the shutter member 106. The sensor unit 100 includes an electrical circuit board 108 configured to process electric signals of the registration sensors 102, the density sensors 103, and the shutter driving portion 107.

As illustrated in FIGS. 3 and 4, the housing 110, which is made up of the frame 101 and the sensor supporting plate 104, has a box shape that is long in the widthwise direction of the intermediate transfer belt 7 (direction substantially orthogonal to the conveyance direction). The frame 101 forms the front, rear, left, right, and upper side surfaces in the housing 110. The sensor supporting plate 104 forms the lower side surface in the housing 110. The frame 101 is provided with a positioning portion 109. The sensor unit 100 is fixed to the main body 9 of the apparatus by the positioning portion 109 fit to a unit positioning portion (not illustrated) in the main body 9 of the apparatus. The sensor supporting plate 104 is mounted on the frame 101 such that it can slide in a substantially vertical direction with respect to the intermediate transfer belt 7. The sensor supporting plate 104 is urged toward the intermediate transfer belt 7 by a pressing spring (not illustrated) as an urging unit disposed inside the housing 110. The sensor supporting plate 104 is provided with a sensor positioning portion 119 to maintain the distance between the intermediate transfer belt 7 and the registration sensors 102 and density sensors 103 constant. The sensor positioning portion 119 abuts an abutment 76 in the intermediate transfer belt unit 70. The abutment 76 is disposed on a rotation shaft of the backup roller 74 arranged on the inner circumferential surface side of the intermediate transfer belt 7. The backup roller 74 can suppress fluttering of the intermediate transfer belt 7. This stabilizes detection performance of the registration sensors 102 and the density sensors 103.

In the present embodiment, the backup roller 74 is disposed with the aim of suppressing fluttering of the intermediate transfer belt 7. Other members may also be used. For example, a support member (backup member) in any other form, such as a support metal plate for suppressing fluttering of the intermediate transfer belt 7, may be disposed.

As illustrated in FIG. 8, the detection surfaces 112 of the registration sensors 102 and the density sensors 103 in the sensor supporting plate 104 face the surface of the intermediate transfer belt 7 through the detection openings 113 in the sensor supporting plate 104. This enables the registration sensors 102 and the density sensors 103 to detect the color misalignment correction patch and the density correction patch on the surface of the intermediate transfer belt 7, respectively. The number of the registration sensors 102 is three, and they are arranged along the widthwise direction of the intermediate transfer belt 7. The amount of misalignment for each color is calculated on the basis of results of detection of the color misalignment correction patch for each of the colors, yellow, magenta, cyan, and black by the registration sensors 102. The amount of misalignment calculated here contains a positional deviation of the beginning of writing for each color in the conveyance direction of the intermediate transfer belt 7, a positional deviation of the beginning of writing for each color in the widthwise direction of the intermediate transfer belt 7, an inclination deviation with respect to the reference direction for each color, and a magnification deviation for each color. The calculated amount of misalignment is processed by an image control unit in the controller 200 and is fed back to an image to be output. The number of the density sensors 103 is three, and they are arranged in the widthwise direction of the intermediate transfer belt 7. The density sensors 103 detect the density correction patch for each of the colors, yellow, magenta, cyan, and black, and the amount of change in density for each color is calculated on the basis of the results of the detection. The calculated amount of change in density is processed by a density control unit in the controller 200 and is fed back to control in the image forming portion P. The number of the registration sensors 102 and that of the density sensors 103 are not limited to those in the present embodiment.

As illustrated in FIG. 5, each of the registration sensors 102 includes elements described below as main components. First, the registration sensor 102 includes a sensor housing 114. The registration sensor 102 also includes a light source (light-emitting diode (LED) light source in the present embodiment) 115, a lens 116 configured to concentrate light reflected from an object to be detected, and a light receiving portion (photodiode in the present embodiment) 117 configured to receive the concentrated light, inside the sensor housing 114. The registration sensor 102 further includes a substrate 118 on which the light source 115 and the light receiving portion 117 are implemented. The registration sensor 102 includes the detection surface (cover glass) 112 as a dustproof member. The detection surface 112 is made of a glass plate and is disposed so as to be oriented in the direction of the object to be detected and so as to be opposed to the intermediate transfer belt 7. The distance between the detection surface 112 and the surface of the intermediate transfer belt 7 is set to about 5 mm. The configuration of the registration sensor 102 is not limited to that in the present embodiment.

As illustrated in FIG. 6, each of the density sensors 103 includes elements described below as main components. The same reference numerals are used in elements having functions identical with or corresponding to those in the registration sensor 102. First, the density sensor 103 includes the sensor housing 114. The density sensor 103 also includes the light source (LED light source in the present embodiment) 115 and the light receiving portion (photodiode in the present embodiment) 117 configured to receive light from an object to be detected. The density sensor 103 further includes the substrate 118 on which the light source 115 and the light receiving portion 117 are implemented. The density sensor 103 includes the detection surface (cover glass) 112 as a dustproof member. The detection surface 112 is made of a glass plate and is disposed so as to be oriented in the direction of the object to be detected and so as to be opposed to the intermediate transfer belt 7. The distance between the detection surface 112 and the surface of the intermediate transfer belt 7 is set to about 5 mm. The configuration of the density sensor 103 is not limited to that in the present embodiment.

In the present embodiment, the registration sensor 102 measures the amount of misalignment in the color misalignment correction patch for each color on the basis of the difference between the amount of light reflected from the intermediate transfer belt 7 and the amount of light reflected from the color misalignment correction patch, and the amount of correction of the position of the beginning of writing for each color is calculated. In the present embodiment, the density sensor 103 measures the difference between the amount of light reflected from a density reference member (described below) disposed on the shutter member 106 and the amount of light reflected from the density correction patch and measures the density of the image of the density correction patch for each color on the basis of that difference. The amount of correction of the density of the image for each color is calculated.

As illustrated in FIG. 3, the shutter member 106 is connected to the shutter driving portion 107 through a follower 165. The follower 165 may be integral with the shutter member 106 or connected to the shutter member 106. In the present embodiment, the follower 165 is integral with the shutter member 106. The shutter member 106 is a substantially plate member having a substantially rectangular shape that is long in the widthwise direction of the intermediate transfer belt 7 and is mounted on the frame 101 such that it can slide along the widthwise direction of the intermediate transfer belt 7. The shutter member 106 is urged backward along the widthwise direction of the intermediate transfer belt 7 by a tension spring 166 (FIG. 10) as an urging unit. The shutter member 106 is opened or closed by the drive motor (shutter opening/closing cam drive motor) 171 and a drive cam (shutter opening/closing cam) 172 in the shutter driving portion 107. The shutter driving portion 107 will be described in further detail below.

The shutter member 106 is arranged between the housing 110 and the intermediate transfer belt 7. That is, the shutter member 106 is arranged between the intermediate transfer belt 7 and each of the registration sensors 102 and the density sensors 103 exposed through the detection openings 113. The shutter member 106 can move between an open position where the detection surface 112 of each of the registration sensors 102 and the density sensors 103 is exposed to the intermediate transfer belt 7 and a closed position where the detection surface 112 is shielded from the intermediate transfer belt 7. In the present embodiment, as described below, the shutter member 106 is moved to the closed position by being moved forward by the drive cam 172 against an urging force of the above-described tension spring and is moved to the open position by being moved backward by release of the pressing by the drive cam 172. As illustrated in FIG. 7, the shutter member 106 includes exposing portions 161 for exposing the detection surfaces 112 of the registration sensors 102 and the density sensors 103 to the intermediate transfer belt 7 when it is in the open position. The shutter member 106 includes shielding portions 162 arranged between the intermediate transfer belt 7 and the detection surfaces 112 of the registration sensors 102 and the density sensors 103 when it is in the closed position. When the shutter member 106 is in the open position, the exposing portions 161, which are openings, are arranged under the detection surfaces 112 to allow the registration sensors 102 and the density sensors 103 to detect an object to be detected on the surface of the intermediate transfer belt 7. When the shutter member 106 is in the closed position, the detection surfaces 112 are covered with the shielding portions 162 to prevent smudges of, for example, toner from adhering to the registration sensors 102 and the density sensors 103. The shutter member 106 includes density reference members (density reference plates) 163 for correcting results of detection by the density sensors 103. The density reference members 163 are arranged under the detection surfaces 112 of the density sensors 103 when the shutter member 106 is in the closed position.

In the present embodiment, all of the sensors 102 and 103 in the sensor unit 100 is able to detect a patch when the shutter member 106 is in the open position and is unable to detect it when the shutter member 106 is in the closed position.

3. Shutter Driving Portion

Figure 9:
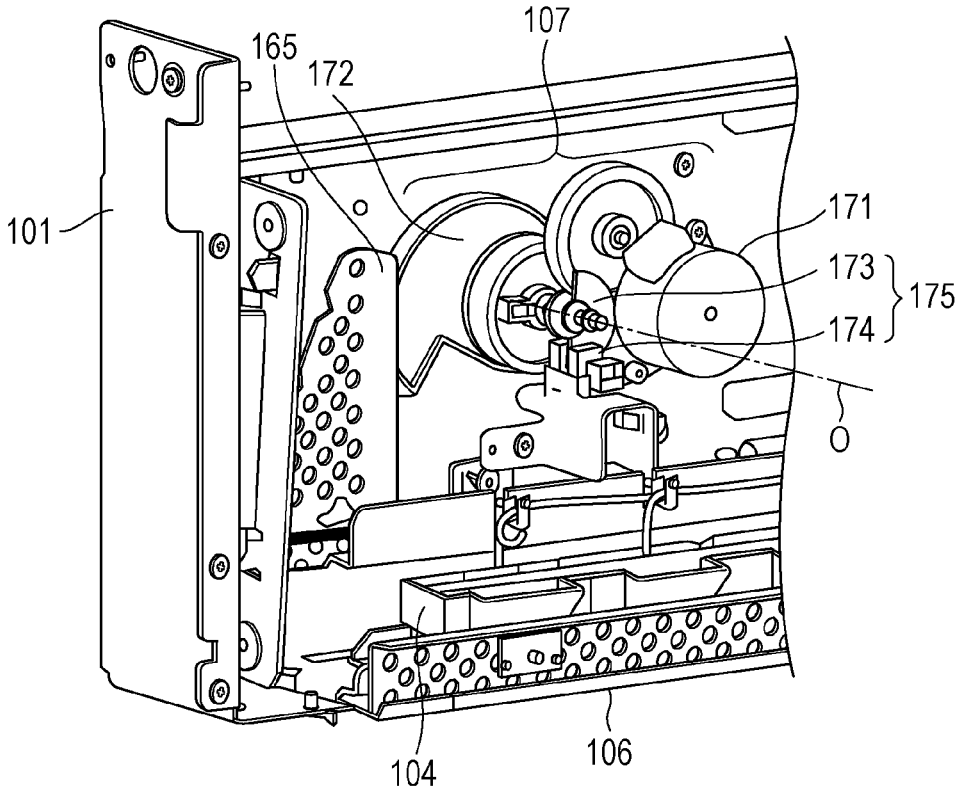
FIG. 9 is a perspective view that illustrates a shutter driving portion.

Next, the configuration of the shutter driving portion 107 is described in further detail. FIG. 9 is a perspective view that illustrates an inside of the sensor unit 100 as seen from the right side of the image forming apparatus 10 and that illustrates the shutter driving portion 107 and its surroundings in further detail. FIGS. 10 to 13 are schematic diagrams that illustrate motion of the shutter driving portion 107.

As described above, the shutter driving portion 107 includes the drive motor 171 and the rotatable drive cam 172 configured to move the shutter member 106. The shutter member 106 is connected to the shutter driving portion 107 through the follower 165 and is opened or closed by the drive motor 171 and the drive cam 172.

The drive cam 172 includes a home-position sensor 175 as a phase detecting unit configured to detect a phase (rotation position) of the drive cam 172. The home-position sensor 175 includes a flag 173 and a photo-interrupter 174. The flag 173 is fixed coaxially with the drive cam 172 and rotates with the same phase as the drive cam 172. The photo-interrupter 174 is configured to detect the flag 173. The home-position sensor 175 detects the phase of the drive cam 172, and the controller 200 controls driving of the drive motor 171 on the basis of the detection. With this control, the position of the shutter member 106 can be controlled.

In the present embodiment, the shutter member 106 can reciprocate along the forward and backward direction of the image forming apparatus 10. A movement direction from the front side toward the rear side of the shutter member 106 is a first movement direction, and its opposite direction is a second movement direction. In the present embodiment, the drive cam 172 can rotate about a rotary axis O (FIG. 9) extending along a direction substantially orthogonal to the movement direction of the shutter member 106 (substantially parallel with a plane of the shutter member 106). A clockwise rotary direction as seen from the right side of the image forming apparatus 10 (front side in the sheet surface in FIGS. 10 to 13) along the rotary axis direction of the drive cam 172 is a positive direction (first rotary direction), and its opposite rotary direction is an opposite direction (second rotary direction).

As described above, toner scattered from the surface of the intermediate transfer belt 7 may adhere to and settle on the surface of the shutter member 106 arranged between the intermediate transfer belt 7 and each of the registration sensors 102 and the density sensors 103. The settled toner may inadvertently fall on an image on the intermediate transfer belt 7 and may cause a malfunction, such as image soiling called "dropped."

Figure 10:
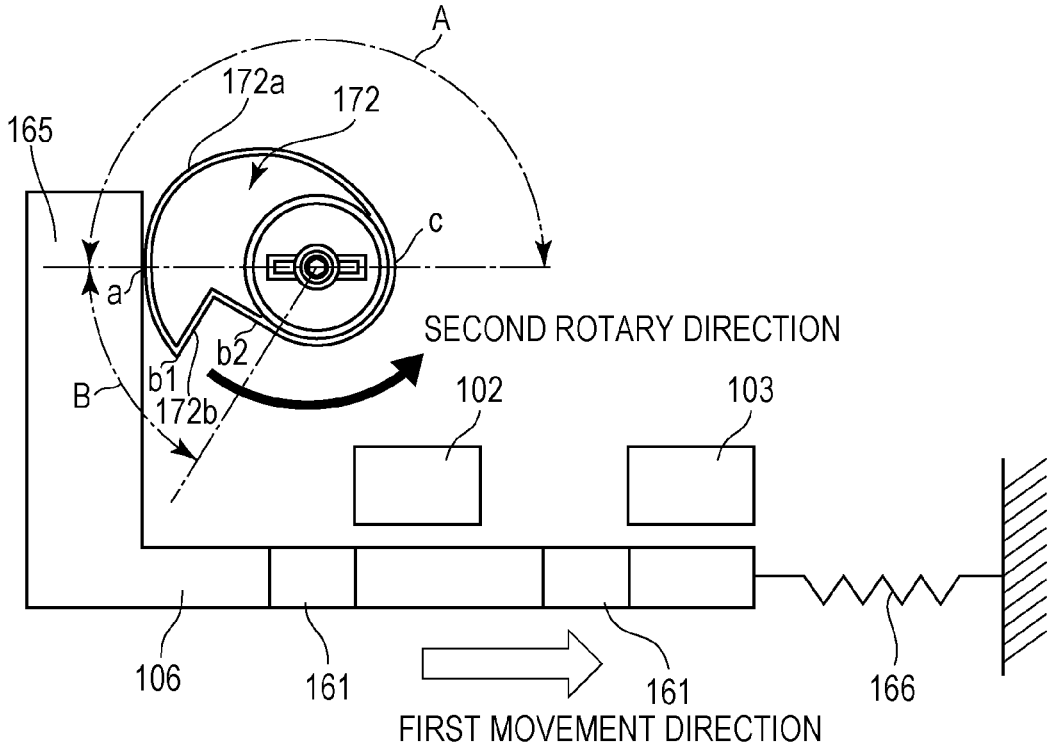
FIG. 10 is a schematic diagram that illustrates motion of a drive cam and the shutter member.

In the present embodiment, as described in detail below, the controller 200 is configured to selectively execute the following first mode and second mode. That is, in the first mode, the shutter member 106 is opened or closed by rotation of the drive cam 172 within a first phase range. In the second mode, the shutter member 106 is vibrated by rotation of the drive cam 172 at least through a second phase range different from the first phase. As illustrated in FIG. 10, the drive cam 172 has a first area (opening/closing area) A for acting on the shutter member 106 and moving the shutter member 106 when the drive cam 172 rotates within the first phase range. The drive cam 172 has a second area (vibrating area) B for acting on the shutter member 106 and providing impact to the shutter member 106 when the drive cam 172 rotates in the second phase range. In the present embodiment, the drive cam 172 includes an opening/closing portion 172*a* in the first area A. The opening/closing portion 172*a* is a cam surface in which the distance from the rotation center of the drive cam 172 continuously increases or decreases in the circumferential direction. In the present embodiment, the drive cam 172 includes a vibrating portion 172*b* in the second area B. The vibrating portion 172*b* is a step as a vibrating unit configured to vibrate the shutter member 106.

Next, an operation of opening and closing the shutter member 106 in the first mode (first opening/closing mode) is described.

Figure 11:
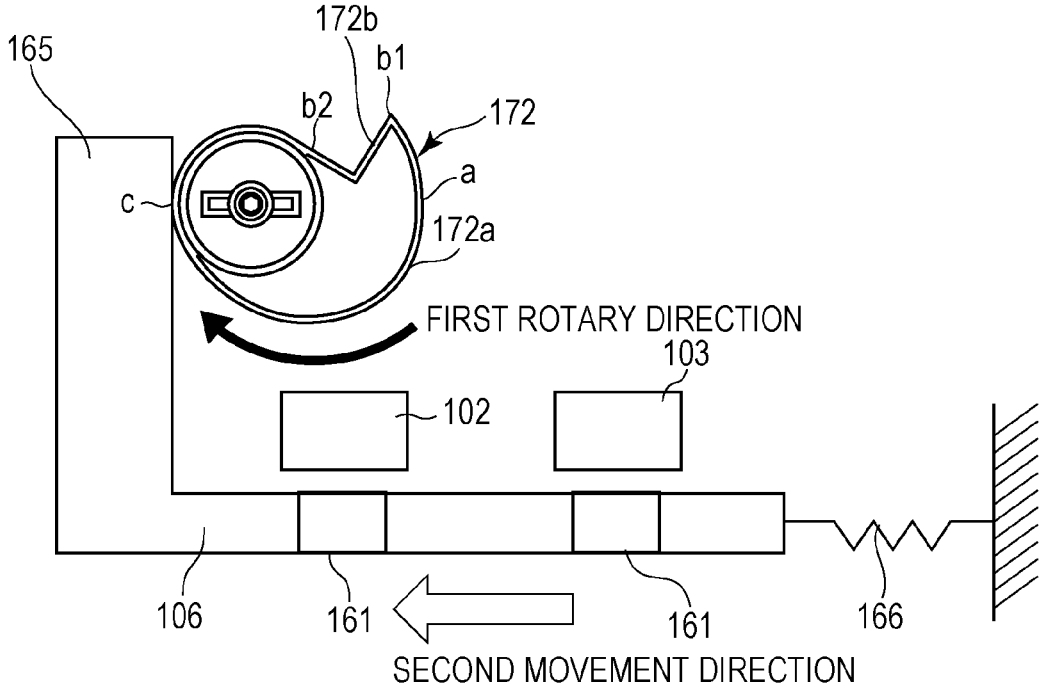
FIG. 11 is a schematic diagram that illustrates motion of the drive cam and the shutter member.

FIG. 10 illustrates a state where the shutter member 106 is in the closed position (state where the shutter member 106 is moved to the endpoint in the second movement direction). In this state, the follower 165 is in contact with a first end section "a" in the opening/closing portion 172*a*, the first end section a lying in an approximately maximum diameter part in the drive cam 172. FIG. 11 illustrates a state where the shutter member 106 is in the open position (state where the shutter member 106 is moved to the endpoint in the first movement direction). In this state, the follower 165 is in contact with a second end section "c" in the opening/closing portion 172*a*, the second end section c lying in an approximately minimum diameter part in the drive cam 172.

To move the state where the shutter member 106 is closed to the state where it is opened in the first mode, the drive cam 172 in the state where the shutter member 106 is in the closed position in FIG. 10 is rotated in the opposite direction (second rotary direction). With this rotation, the shutter member 106 is moved in the first movement direction, and the state is shifted to that where the shutter member 106 is in the open position illustrated in FIG. 11. That is, the state where the first end section a, which lies in the approximately maximum diameter part in the drive cam 172, of the opening/closing portion 172*a* is in contact with the follower 165 is shifted to the state where the second end section c, which lies in the approximately minimum diameter part in the drive cam 172, of the opening/closing portion 172*a* is in contact with the follower 165. In this manner, the shutter member 106 is moved from the closed state to the open state.

To move the state where the shutter member 106 is opened to the state where it is closed in the first mode, the drive cam 172 in the state where the shutter member 106 is in the open position illustrated in FIG. 11 is rotated in the positive direction (first rotary direction). With this rotation, the shutter member 106 is moved in the second movement direction, and the state is shifted to that where the shutter member 106 is in the closed position illustrated in FIG. 10. That is, the state where the second end section c, which lies in the approximately minimum diameter part in the drive cam 172, of the opening/closing portion 172*a* is in contact with the follower 165 is shifted to the state where the first end section a, which lies in the approximately maximum diameter part in the drive cam 172, of the opening/closing portion 172*a* is in contact with the follower 165. In this manner, the shutter member 106 is moved from the open state to the closed state.

As described above, in the first mode, the operation of opening and closing the shutter member 106 is made by the drive cam 172 repeating the substantially semi-perimeter rotation in the positive and opposite directions within the first phase range between the state illustrated in FIG. 10 and that illustrated in FIG. 11. Specific forms of the rotary direction and rotary angle of the drive cam 172 are not limited to those in the present embodiment. In the present embodiment, the shutter member 106 is integral with the follower 165. Other configurations may also be used. For example, they may be separated and connected in action.

Next, timings of the operation of opening and closing the shutter member 106 in the first mode are described.

In the present embodiment, the controller 200 controls the opened and closed positions of the shutter member 106 on the basis of a result of detection by the home-position sensor 175. At this time, the controller 200 performs controlling such that opening the shutter member 106 is timed to detect the patch using the sensors 102 and 103. That is, the controller 200 moves the shutter member 106 to the open position immediately before the patch on the intermediate transfer belt 7 passes through the portions opposed to the sensors 102 and 103 and moves the shutter member 106 to the closed position immediately after the patch passes through the portions opposed to the sensors 102 and 103. For example, the controller 200 can perform controlling so as to move the shutter member 106 to the open position immediately before a series of patches to be detected sequentially in a first period is conveyed to the portions opposed to the sensors and so as to move the shutter member 106 to the closed position immediately after that series of patches passes through the portions opposed to the sensors. In the present embodiment, the period of time for which the shutter member 106 is opened is approximately 0.3 seconds. The timing when the shutter member 106 is opened and the duration of the opening are not limited to those in the present embodiment.

Next, the operation of vibrating the shutter member 106 in the second mode (second opening/closing mode) is described.

Figure 12:
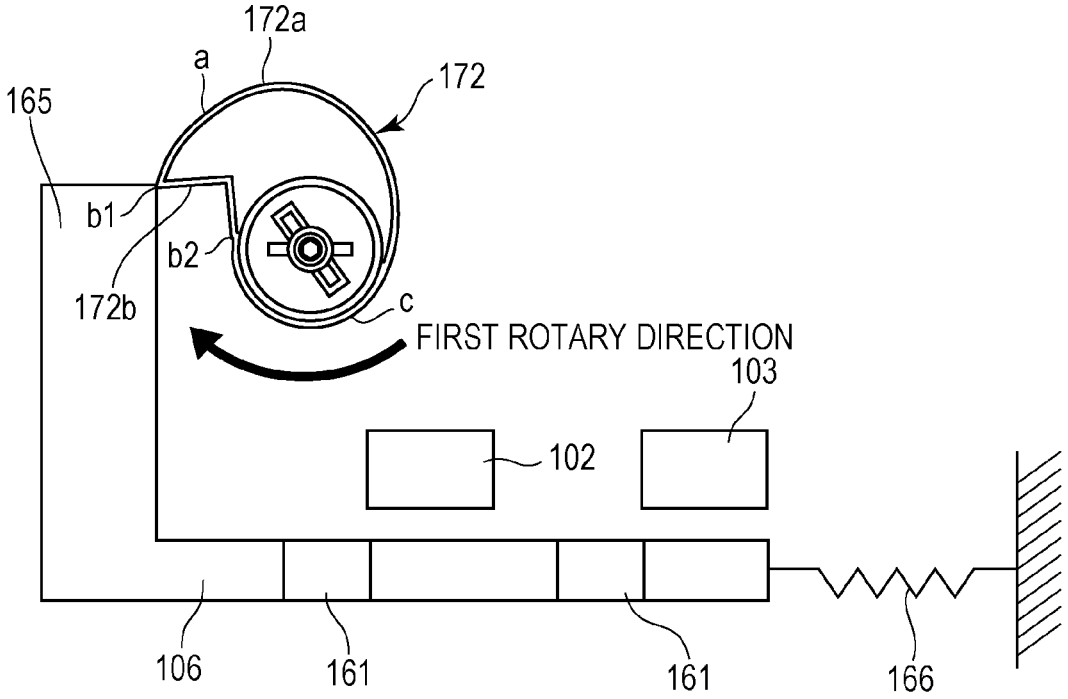
FIG. 12 is a schematic diagram that illustrates motion of the drive cam and the shutter member.

FIG. 12 illustrates a state where the drive cam 172 in the state where the shutter member 106 is in the closed position illustrated in FIG. 10 is further rotated in the positive direction (first rotary direction). At this time, the drive cam 172 exits from the first phase range, enters the second phase range, and is brought into the state where a portion located immediately in front of the vibrating portion 172*b*, which is a step in the second area B in the drive cam 172, is in contact with the follower 165. The portion located immediately in front of the vibrating portion 172*b* in the drive cam 172 lies in the approximately maximum diameter part. Thus the shutter member 106 remains in the closed position.

Figure 13:
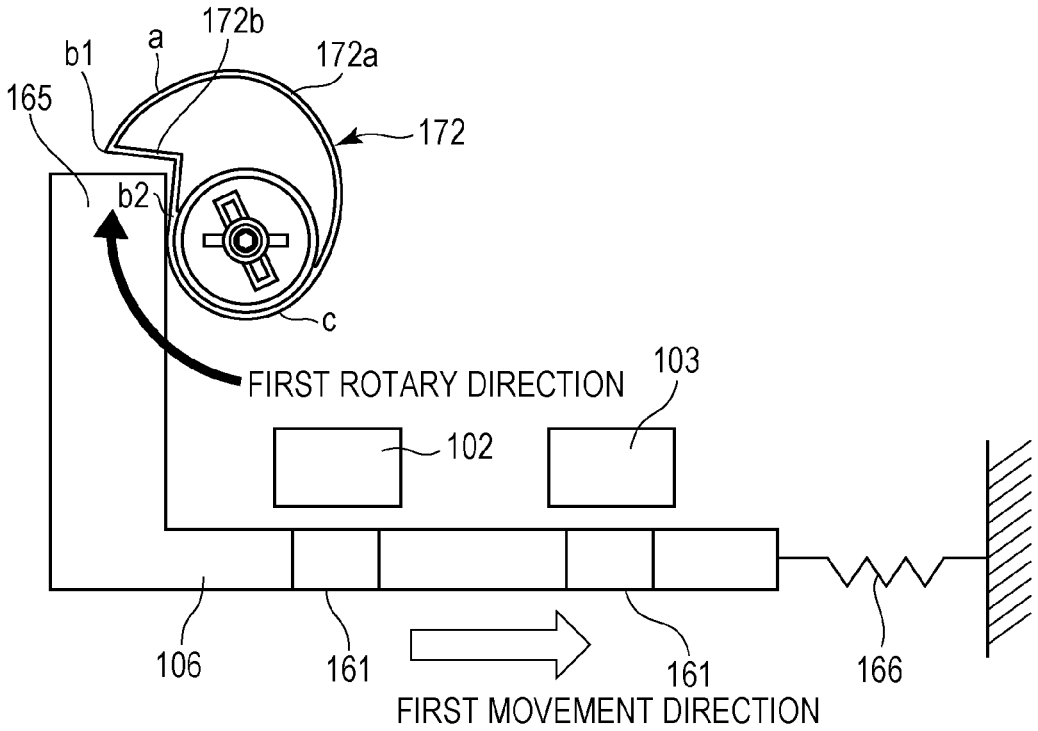
FIG. 13 is a schematic diagram that illustrates motion of the drive cam and the shutter member.

FIG. 13 illustrates a state where the drive cam 172 in the state illustrated in FIG. 12 is further rotated in the positive direction (first rotary direction). At this time, the position of the drive cam 172 in contact with the follower 165 is abruptly shifted from an apex b1 of the vibrating portion 172*b*, the apex b1 lying in the approximately maximum diameter part in the drive cam 172, to a bottom b2, which lies in the approximately minimum diameter part. Here, the shutter member 106 is urged by the tension spring 166 in the first movement direction. Thus the shutter member 106 is drastically moved in the first movement direction by shifting the position of the drive cam 172 in contact with the follower 165 as described above, and the follower 165 comes into contact with the bottom b2 of the vibrating portion 172*b* in the drive cam 172 with an impact force. In this manner, the shutter member 106 is vibrated. Because the bottom b2 of the vibrating portion 172*b* in the drive cam 172 lies in the approximately minimum diameter part, the shutter member 106 is in the open position. After the shutter member 106 is vibrated in the above-described manner, the drive cam 172 is further rotated in the positive direction (first rotary direction). With this rotation, the second end section c and the first end section a of the opening/closing portion 172*a* sequentially come into contact with the follower 165, and the state is shifted to the one where the shutter member 106 is in the closed position (FIG. 10).

In this manner, the shutter member 106 can be vibrated in the second mode. By a single vibrating operation in the second mode, the vibrating portion 172*b* may be made to pass through the position in contact with the follower 165 once and vibrate the shutter member 106 once, or the vibrating portion 172*b* may be made to pass through the position more than once and repeatedly vibrate the shutter member 106. Any settings may be used to sufficiently shake an adhering substance, such as toner, from the shutter member 106.

In color misalignment correction or density correction, shaking adhering and settling toner from the surface of the shutter member 106 can be suppressed by operating the shutter member 106 in the first mode. In contrast, the shutter member 106 can be vibrated and adhering and settling toner can be shaken from the shutter member 106 by operating the shutter member 106 in the second mode. The toner shaken from the shutter member 106 falls onto the intermediate transfer belt 7.

A specific shape of the vibrating portion 172*b*, such as height of the step, may be set to any shape that allows an impact load that can sufficiently shake toner from the shutter member 106 to be provided to the shutter member 106. Here, the substance adhering to the shutter member 106 is not limited to toner and may be any matter (mainly powder or granular matter) that can scatter or float inside the main body 9 of the apparatus and that can adhere to the shutter member 106. Examples of the adhering substance may include an external additive of toner and paper dust. In the present embodiment, the follower 165 changes it position in a way that it does not slide along the circumferential surface and falls from the apex b1 to the bottom b2 in the vibrating portion 172*b* at the vibrating portion 172*b*. The vibrating portion 172*b* may include a cam surface in which the distance from the rotation center decreases gradually but sharply just enough to sufficiently vibrate the shutter member 106, and the follower 165 may change its position along the cam surface. In this case, the shutter member 106 typically moves at the vibrating portion 172*b* with a moving speed higher than that at the opening/closing portion 172*a*, and a sufficient impact load is provided to the shutter member 106 at the endpoint of the movement. In the present embodiment, the vibrating portion 172*b* is a single step. The vibrating portion 172*b* may also include a plurality of steps.

Next, timings of the operation of vibrating the shutter member 106 in the second mode are described.

As described above, when the shutter member 106 is operated in the second mode, toner falls from the shutter member 106 onto the intermediate transfer belt 7. Accordingly, in execution of the second mode, it is necessary to have no output image to be recorded and output on the transfer material S or no reference image (e.g., color misalignment correction patch or density correction patch) on the intermediate transfer belt 7 opposed to the shutter member 106. That is, the second mode is executed when there is no image conveyed by the image conveyance member on the portion opposed to the sensor. In the present embodiment, the second mode is executed at a predetermined timing when no patch is conveyed to the portion opposed to the shutter member 106 during no image formation, other than during output image formation. Examples of during no image formation may include during pre-multi-rotation, during pre-rotation, during sheet-to-sheet interval, during post rotation, and during standby. During pre-multi-rotation, a predetermined preparatory operation is performed, and examples of during pre-multi-rotation may include during power-up of the image forming apparatus and during returning from a sleep mode. During pre-rotation, a predetermined preparatory operation is performed after a signal of a job (a series of image formation operations for a single transfer material or a plurality of transfer materials activated by a first start instruction) is input and before an image is actually written. During sheet-to-sheet interval corresponds to an interval between transfer materials in a job of sequentially forming images on the plurality of transfer materials. During post rotation, a predetermined organizing operation (preparatory operation) is performed after the completion of a job. During standby, an input of a signal of a job is waited. In particular, in the present embodiment, the operation of vibrating the shutter member 106 in the second mode is performed during post rotation.

At the time when the operation of vibrating the shutter member 106 in the second mode is performed, the intermediate transfer belt 7 may be rotating. That is, the second mode may be executed during movement of the image conveyance member. In other words, toner caused to fall from the shutter member 106 onto the intermediate transfer belt 7 by vibration can be collected by the belt cleaner 75, which is disposed downstream of the portion opposed to the sensor unit 100 in the conveyance direction of the intermediate transfer belt 7. Alternatively, if a secondary transfer member cleaner (not illustrated) for cleaning the secondary transfer roller 8 is disposed, toner transferred from the intermediate transfer belt 7 to the secondary transfer roller 8 can be collected by the secondary transfer member cleaner. In this case, the operation of vibrating the shutter member 106 in the second mode performed during rotation of the intermediate transfer belt 7 allows toner to be dispersed without causing much toner to fall to one spot in the conveyance direction of the intermediate transfer belt 7, and thus the load for collecting toner in the above-described cleaner can be reduced. Other configurations may also be used. The operation of vibrating the shutter member 106 in the second mode may be performed at a desired timing when the intermediate transfer belt 7 does not rotate.

As described above, in the present embodiment, malfunction, such as image soiling caused by inadvertent falling of toner adhering to and settling on the openable/closable shutter member 106, which protects the sensors 102 and 103, can be suppressed.

Other Embodiments

The present invention is described above on the basis of the specific embodiment, but is not limited to the above-described embodiment.

For example, in the above-described embodiment, the shutter member is moved from the closed position to the open position by being moved by the tension spring in the urging direction. Other configurations may also be used. With the above-described movement form, the operation of opening the shutter member can be performed at a relatively high speed. The relationship between the movement direction and the open and closed positions of the shutter member is not limited to that in the above-described embodiment. A relationship opposite to that in the above-described embodiment may also be used.

In the above-described embodiment, the case where the image conveyance member is the intermediate transfer member is described. Other cases may also be used. For example, as is known to those skilled in the art, there is an image forming apparatus employing a direct transfer method. This image forming apparatus includes a transfer-material carrying member as the image conveyance member, in place of the intermediate transfer member in the above-described embodiment, and forms an image by transferring a toner image on a transfer material carried on the transfer-material carrying member. One example of the transfer-material carrying member may be a transfer-material carrying belt similar to the intermediate transfer belt in the above-described embodiment. In such an image forming apparatus, a reference image (toner image for adjustment, such as color misalignment correction patch or density correction patch) is formed on the transfer-material carrying member or a transfer material carried on the transfer-material carrying member, it is detected by the sensors, and controlling for correcting the color misalignment and the density of the image is performed. Accordingly, the application of the present invention to a sensor unit in the above-described image forming apparatus can provide substantially the same advantages as in the above-described embodiment. The image conveyance member may also be a photosensitive member having a drum shape or an endless belt shape. The application of the present invention to a sensor unit configured to detect a reference image (toner image for adjustment, such as density correction patch) formed thereon can provide substantially the same advantages as in the above-described embodiment.

In the above-described embodiment, the sensors are optical sensors. Other sensors may also be used. Any sensor that is opposed to the movable image conveyance member and configured to detect a state of an object to be detected on the image conveyance member may also be used. For example, if the image conveyance member is a photosensitive member, the sensors may be potential sensors configured to detect a surface potential of the photosensitive member as the state on the photosensitive member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-074927, filed Mar. 31, 2014, which is hereby incorporated by reference herein in its entirety.

What is claimed is:

1. An image forming apparatus comprising:

a movable image-bearing member configured to bear a toner image;

a sensor opposed to the image-bearing member;

a shutter member arranged between the sensor and the image-bearing member configured to be movable between an open position and closed position, the sensor being exposed to the image-bearing member at the open position, the sensor being shielded from the image-bearing member at the closed position;

a rotatable cam configured to move the shutter member, the cam being rotatable in a first phase range and a second phase range, the second phase range being not contained in the first phase range, a distance from a rotation center of the cam continuously increasing or decreasing in a circumferential direction in the first phase range, the distance varying in a stepped manner in the circumferential direction in the second phase range; and an execution portion capable of selectively executing a first mode and a second mode, the cam being rotated within the first phase range for moving the shutter member from the open position to the closed position mutually in the first mode, the cam being rotated at least through the second phase range for applying an impact to the shutter member in the second mode.

2. The image forming apparatus according to claim 1, wherein the shutter member is capable of reciprocating in a first movement direction and a second movement direction opposite to the first movement direction and is urged in the first movement direction, in the first mode, the execution portion is configured to rotate the cam in a first rotary direction to move the shutter member in the second movement direction and configured to rotate the cam in a second rotary direction opposite to the first rotary direction to move the shutter member in the first movement direction, and in the second mode, the execution portion is configured to rotate the cam in the second phase range in the first rotary direction to move the shutter member in the first movement direction and apply the impact to the shutter member.

3. The image forming apparatus according to claim 2, wherein the execution portion is configured to rotate the cam in the second rotary direction in the first mode to move the shutter member from the closed position to the open position and configured to rotate the cam in the first rotary direction in the first mode to move the shutter member from the open position to the closed position.

4. The image forming apparatus according to claim 1, wherein the execution portion is configured to execute the second mode when the toner image borne on the image-bearing member is absent in a portion opposed to the sensor.

5. The image forming apparatus according to claim 1, wherein the execution portion is configured to execute the second mode while the image-bearing member is moving.

6. The image forming apparatus according to claim 1, wherein the image-bearing member is an endless belt stretched around a plurality of supporting rollers.

7. The image forming apparatus according to claim 6, wherein the sensor is arranged in a location opposed to one of the plurality of supporting rollers such that the image-bearing member is disposed therebetween.

8. The image forming apparatus according to claim 7, wherein the sensor is configured to detect the toner image on the image-bearing member or a recording medium borne on the image-bearing member.

9. The image forming apparatus according to claim 1, wherein the sensor includes a light source and a light receiving portion configured to receive light reflected from the image-bearing member.

* * * * *